US010585372B2

(12) United States Patent
Fujino et al.

(10) Patent No.: US 10,585,372 B2
(45) Date of Patent: Mar. 10, 2020

(54) CHARGING ROLLER, CARTRIDGE, AND IMAGE FORMING APPARATUS

(71) Applicant: CANON KABUSHIKI KAISHA, Tokyo (JP)

(72) Inventors: Takeshi Fujino, Abiko (JP); Akinori Miyamoto, Bando (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/393,240

(22) Filed: Apr. 24, 2019

(65) Prior Publication Data

US 2019/0346788 A1 Nov. 14, 2019

(30) Foreign Application Priority Data

May 10, 2018 (JP) ..... 2018-091552

(51) Int. Cl.
*G03G 15/02* (2006.01)

(52) U.S. Cl.
CPC ..... *G03G 15/0233* (2013.01); *G03G 15/0225* (2013.01); *G03G 2215/025* (2013.01)

(58) Field of Classification Search
CPC ..... G03G 15/0216; G03G 15/0225; G03G 15/0233
USPC ..... 399/107, 110, 111, 115, 168, 174, 176
See application file for complete search history.

(56) References Cited

U.S. PATENT DOCUMENTS

| | | | | |
|---|---|---|---|---|
| 5,576,806 | A * | 11/1996 | Oka | G03G 15/0233 361/225 |
| 9,939,752 | B2 | 4/2018 | Imase | |
| 10,203,626 | B2 * | 2/2019 | Ito | G03G 15/16 |
| 10,268,132 | B2 | 4/2019 | Fujino et al. | |
| 2018/0101107 | A1 | 4/2018 | Tomomizu et al. | |
| 2018/0364605 | A1 | 12/2018 | Yoshida et al. | |

FOREIGN PATENT DOCUMENTS

| | | | | |
|---|---|---|---|---|
| JP | 2010-96267 | A | 4/2010 | |
| JP | 2017-107147 | A | 6/2017 | |
| JP | 2018-060162 | * | 4/2018 | G03G 15/0233 |
| JP | 2018-63425 | A | 4/2018 | |

OTHER PUBLICATIONS

U.S. Appl. No. 16/393,212, filed Apr. 24, 2019.
U.S. Appl. No. 16/393,224, filed Apr. 24, 2019.

* cited by examiner

*Primary Examiner* — Hoan H Tran
(74) *Attorney, Agent, or Firm* — Venable LLP

(57) ABSTRACT

A charging roller is configured to charge a surface of an image bearing member configured to bear an image. The charging roller includes: a shaft portion; an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$.

12 Claims, 2 Drawing Sheets

CHARGING ROLLER, CARTRIDGE, AND IMAGE FORMING APPARATUS

BACKGROUND OF THE INVENTION

Field of the Invention

The present invention relates to a charging roller configured to charge an image bearing member in an electrophotographic process, and to a cartridge and an image forming apparatus including the charging roller.

Description of the Related Art

For a charging unit configured to charge an image bearing member in an image forming apparatus of an electrophotographic system, a contact charging system in which a voltage is applied to a charging roller brought into contact with the image bearing member is widely used. Such a charging roller is known to be capable of suppressing abnormal electrical discharge, which leads to deterioration of image quality, by smoothing the surface thereof. Meanwhile, in the case where the smoothness of the charging roller is too high, the contact area between the charging roller and soiling matter such as toner attached to the image bearing member increases, thus a filming phenomenon in which the soiling matter attaches to the charging roller becomes more likely to occur, and as a result the lifetime of the charging roller sometimes becomes shorter.

Conventionally, a technique of imparting appropriate surface roughness to a charging roller to extend the lifetime of the charging roller while suppressing abnormal electrical discharge to an acceptable level or lower is known. Japanese Patent Laid-Open No. 2010-096267 discloses a charging roller having a surface roughness of 2 to 15 μm and configured such that the sum of frequencies below the mode and the sum of frequencies equal to or above the mode in a frequency distribution of surface height of the charging roller has a predetermined ratio. This surface roughness specified in the document above is ten point height of roughness profile Rzjis defined in Japanese Industrial Standards JIS B0601 (1994). According to the document above, by setting the surface roughness to such a value, transfer of toner particles from a photosensitive drum to a projecting portion of the charging roller is suppressed, and thus occurrence of filming is suppressed.

In recent years, accompanied by increase in the durability of a photosensitive drum used as an image bearing member, it is requested that the charging roller also maintains its performance for a long period of time. According to the study by the inventors, it has been found that not only filming caused by attachment of toner, that is, toner filming, but also filming caused by attachment of particles smaller than toner particles is a problem. A typical example of the particles smaller than the toner particles is an external additive added to developer.

When filming caused by attachment of an external additive detached from toner particles to the charging roller, that is, external additive filming occurs, typically an image defect occurs as a high-density streak in a halftone image. However, as found by intensive study by the inventors, the image defect caused by the external additive filming cannot be effectively suppressed by the configuration disclosed in the document above.

SUMMARY OF THE INVENTION

The present invention provides a charging roller, a cartridge with a charging roller, and an image forming apparatus with a charging roller that can maintain image quality for a long period of time.

According to one aspect of the invention, a charging roller is configured to charge a surface of an image bearing member configured to bear an image. The charging roller includes: a shaft portion; an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$.

According to another aspect of the invention, a cartridge includes: a rotatable image bearing member; and a charging roller configured to charge a surface of the image bearing member. The charging roller includes: a shaft portion; an elastic layer formed around the shaft portion; and a surface layer formed around the elastic layer, wherein the surface layer particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$.

According to still another aspect of the invention, an image forming apparatus includes: a rotatable image bearing member; a charging roller configured to charge a surface of the image bearing member; and a developing unit configured to develop, by using developer containing toner, an electrostatic latent image born on the image bearing member. The charging roller includes: a shaft portion; an elastic layer formed around the shaft portion; and a surface layer formed around the elastic layer, wherein particles having particle diameters within a range of 2 μm or larger and 15 μm or smaller and dispersed in the surface layer, wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$, wherein an average particle diameter of the toner contained in the developer is 10 μm or smaller, and an average particle diameter of an external additive contained in the developer is 0.5 μm or smaller.

According to still another aspect of the invention, a charging roller is configured to charge a surface of an image bearing member configured to bear an image. The charging roller includes: a shaft portion; an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.4 \leq Svk \leq 1$.

Further features of the present invention will become apparent from the following description of exemplary embodiments with reference to the attached drawings.

DESCRIPTION OF THE EMBODIMENTS

Embodiments of the present invention will be described below with reference to drawings.

Image Forming Apparatus

Figure 1:
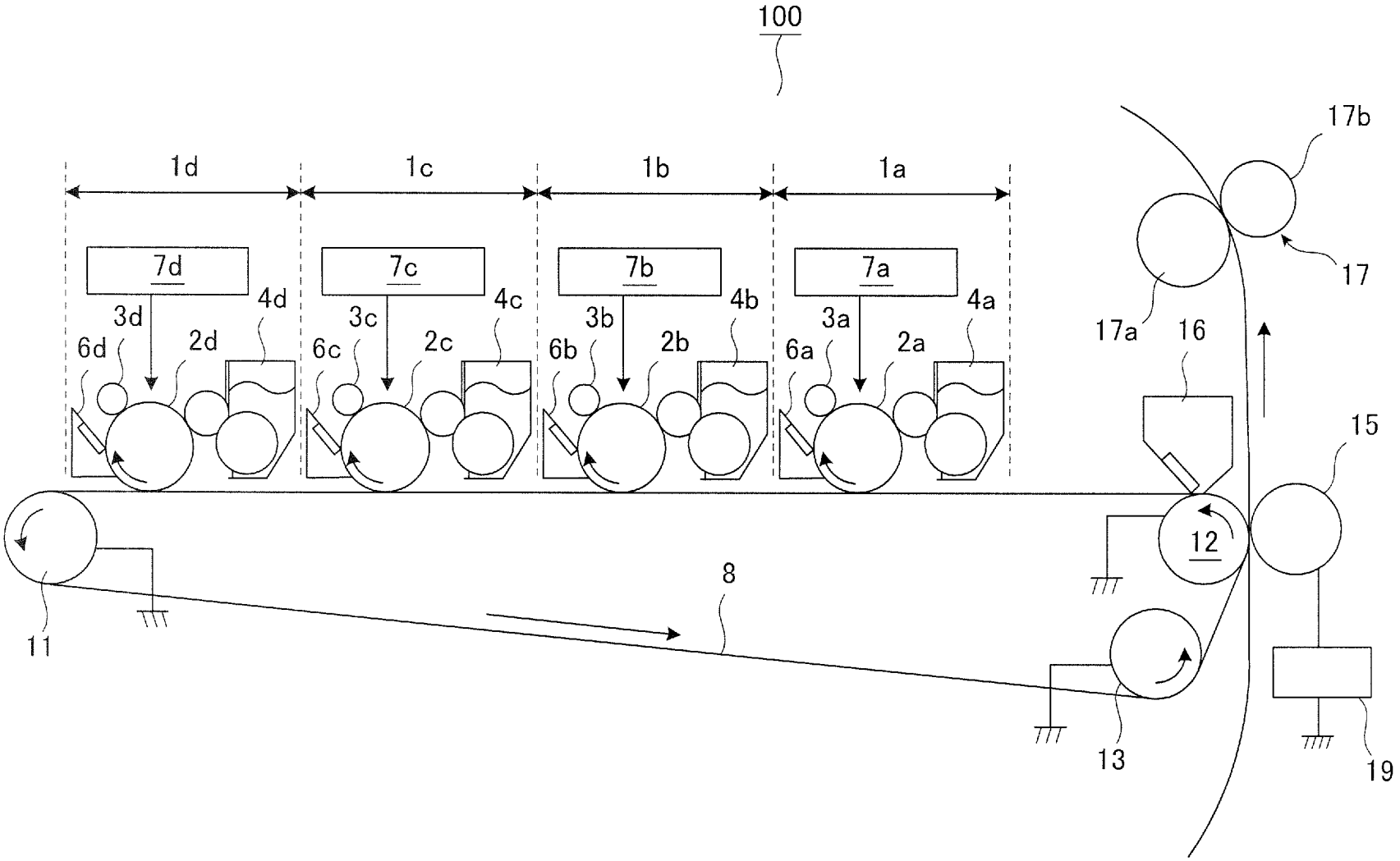
FIG. 1 is a schematic diagram illustrating a configuration of an image forming apparatus according to the present disclosure.

FIG. 1 is a configuration diagram of an image forming apparatus 100 of a 4-drum in-line system. The image forming apparatus 100 includes four image forming units 1*a*, 1*b*, 1*c*, and 1*d* that respectively form images of yellow, magenta, cyan, and black. The four image forming units 1*a*, 1*b*, 1*c*, and 1*d* are arranged in a line with equal intervals therebetween.

The image forming units 1*a* to 1*d* respectively include photosensitive drums 2*a*, 2*b*, 2*c*, and 2*d* serving as image bearing members. The photosensitive drums 2*a* to 2*d* each have a photosensitive layer of an organic photoconductor: OPC having a negative charging polarity on a base drum body of aluminum or the like, and are each rotationally driven by a driving unit at a predetermined process speed.

Charging rollers 3*a*, 3*b*, 3*c*, and 3*d*, developing units 4*a*, 4*b*, 4*c*, and 4*d*, and drum cleaning units 6*a*, 6*b*, 6*c*, and 6*d* are respectively disposed around the photosensitive drums 2*a* to 2*d*. Further, exposing units 7*a*, 7*b*, 7*c*, and 7*d* are respectively disposed above the photosensitive drums 2*a* to 2*d*. The developing units 4*a* to 4*d* respectively accommodate developers containing yellow, cyan, magenta, and black toners.

The image forming units 1*a* to 1*d* are each preferably configured as a cartridge attachable to and detachable from an apparatus body of the image forming apparatus 100. The cartridges according to the present exemplary embodiment at least respectively include the photosensitive drums 2*a* to 2*d* and the charging rollers 3*a* to 3*d*. These cartridges may be also configured as process cartridges further respectively including the developing units 4*a* to 4*d* and the drum cleaning units 6*a* to 6*d*.

An intermediate transfer belt 8 that is a rotatable endless belt is disposed at a position opposing the photosensitive drums 2*a* to 2*d* of the respective image forming units. The intermediate transfer belt 8 serving as an intermediate transfer body is stretched over a driving roller 11, a secondary-transfer opposing roller 12, and a tension roller 13. The intermediate transfer belt 8 is driven by the driving roller 11 connected to a motor, and is thus rotated in an arrow direction, that is, in the counterclockwise direction. The secondary-transfer opposing roller 12 abuts a secondary transfer roller 15 with the intermediate transfer belt 8 therebetween, and thus forms a secondary transfer portion.

A belt cleaning unit 16 that removes and collects transfer residual toner remaining on the intermediate transfer belt 8 is disposed on the outer circumferential side of the intermediate transfer belt 8. In addition, a fixing unit 17 including a fixing roller 17*a* and a pressurizing roller 17*b* for performing a heating/pressurizing process to fix toner on a recording material is disposed downstream of the secondary transfer portion, in which the secondary-transfer opposing roller 12 and the secondary transfer roller 15 abut with each other, in the rotation direction of the intermediate transfer belt 8.

The photosensitive drums 2*a* to 2*d* serve as image bearing members in the present exemplary embodiment. The charging rollers 3*a* to 3*d* serve as charging rollers for charging the surfaces of the image bearing members in the present exemplary embodiment, and the detailed configuration thereof will be described later. The exposing units 7*a* to 7*d* serve as exposing units for drawing electrostatic latent images on the image bearing members in the present exemplary embodiment. The developing units 4*a* to 4*d* serve as developing units for developing the electrostatic latent images born on the image bearing members in the present exemplary embodiment. A transfer unit including the intermediate transfer belt 8 and the secondary transfer roller 15 serves as a transfer unit for transferring toner images born on the image bearing members onto a recording material in the present exemplary embodiment.

When a start signal to start an image forming operation is output from a controller of the image forming apparatus 100, recording materials are delivered out one by one from a cassette, and are conveyed to a registration roller. The recording material stands by in a state of abutting the registration roller in a stationary state. When the start signal is output, the photosensitive drums 2*a* to 2*d* start rotating at a predetermined process speed in the image forming units 1*a* to 1*d*. The photosensitive drums 2*a* to 2*d* are uniformly charged to a negative polarity respectively by the charging rollers 3*a* to 3*d*. The exposing units 7*a* to 7*d* respectively expose the photosensitive drums 2*a* to 2*d* by scanning the photosensitive drums 2*a* to 2*d* by laser light, and thus form electrostatic latent images on the surfaces of the photosensitive drums 2*a* to 2*d*. These electrostatic latent images are developed as toner images by applying a bias voltage having a negative polarity serving as a developing bias to developer bearing members bearing developer in the developing units 4*a* to 4*d*.

For example, the amount of charge and the amount of exposure are adjusted such that the surface potential of the photosensitive drum is −600 V after being charged by the charging roller and is −200 V at a portion exposed by the exposing unit, that is, at an image portion. The developing bias is set to −500 V. The process speed, which is a driving speed of the photosensitive drum, is 240 mm/sec, and an image formation width, which is a length in a direction perpendicular to the conveyance direction corresponding to the rotation direction, is 300 mm. In addition, the amount of charge of the toner used for developing is set to about −30 μC/g, and the amount of toner in a solid image portion on the surface of the photosensitive drum is set to about 0.4 $mg/cm^2$.

Regarding the order of image formation, first, to form a yellow image, by the developing unit 4*a*, yellow toner is attached to the electrostatic latent image formed on the photosensitive drum 2*a*, and thus the electrostatic latent image is visualized as a toner image. This yellow toner image is transferred onto the rotating intermediate transfer belt 8 through primary transfer.

A region to which the yellow toner image on the intermediate transfer belt 8 has been transferred is moved toward the magenta image forming unit 1*b* by the rotation of the intermediate transfer belt 8. Then, also in the image forming unit 1*b*, the magenta toner image formed on the photosensitive drum 2*b* in a similar manner is transferred so as to be superimposed on the yellow toner image on the intermediate transfer belt 8. Subsequently, cyan and black toner images respectively formed on the photosensitive drums 2*c* and 2*d* of the image forming units 1*c* and 1*d* are sequentially transferred so as to be superimposed on the yellow and magenta toner images that have been already transferred, and thus a full-color toner image is formed on the intermediate transfer belt 8.

Then, the registration roller conveys the recording material to the secondary transfer portion at a timing when the leading end of the full-color toner image born on the intermediate transfer belt 8 reaches the secondary transfer portion. A bias voltage having an opposite polarity to the toner serving as a secondary transfer voltage is applied from a transfer power source 19 to the secondary transfer roller 15. As a result of this, the full-color toner image is collectively transferred from the intermediate transfer belt 8 onto the recording material through secondary transfer at the secondary transfer portion. The recording material onto which the toner image has been transferred is conveyed to the fixing unit 17, and is heated and pressurized in a fixing nip portion formed by the fixing roller 17*a* and the pressurizing roller 17*b*. The toners of respective colors solidify and adhere to the recording material after melting, and thus the image is fixed to the recording material. Then, the recording material is discharged onto a discharge tray provided in the image forming apparatus 100 or to a sheet processing apparatus that performs post-processing such as a binding process on the recording material.

The image forming apparatus 100 described above is an example of an image forming apparatus. For example, a system in which a toner image formed on a photosensitive drum is directly transferred onto a recording material without using an intermediate transfer body may be employed. In addition, examples of the image forming apparatus include printers, copiers, facsimile machines, and multifunctional apparatuses having functions of these.

Surface Roughness of Charging Roller

Here, a relationship between the surface roughness of a charging roller, image quality of an image formed by an electrophotographic process, and the lifetime of the charging roller will be described. Conventionally, a technique is known in which an appropriate surface roughness is imparted to a charging roller, in order to suppress toner attachment to the charging roller and thus improve the durability of the charging roller while suppressing abnormal electrical discharge derived from unevenness of the surface to an acceptable level or lower. As an index of the surface roughness, ten point height of roughness profile Rzjis defined in Japanese Industrial Standards JIS B0601 (1994) is widely used (see Appendix JA of JIS B0601 (2013)).

The diameter of toner used in an electrophotography apparatus is typically 10 μm or smaller, and toner having an average particle diameter (volume average particle diameter) of 4 to 8 μm in terms of volume average particle diameter is often employed. However, when toner is transferred from an image bearing member to an intermediate transfer body or to a recording material, toner particles having larger particle diameters are more likely to be transferred, and toner particles having smaller particle diameters are less likely to be transferred. Therefore, toner remaining on the photosensitive drum without being transferred at a transfer portion contains many small particles, for example, particles having a diameter of 3 μm or smaller. Therefore, it can be assumed that, in the case where, for example, the ten point height of roughness profile Rzjis of the surface of the charging roller is set to 2 μm to 15 μm, the number of contact points between the toner particles attached to the photosensitive drum and the surface of the charging roller decreases, and thus toner attachment to the charging roller is suppressed.

However, it has been found that the filming caused by attachment of an external additive, that is, the external additive filming cannot be effectively suppressed by just controlling the ten point height of roughness profile Rzjis as described above. The reason for this is considered to be because primary particles or secondary particles of the external additive have a particle diameter of several tens nanometers to several hundred nanometers, and behave differently from the toner particles, which have a particle diameter of several micrometers. To be noted, the secondary particles refer to aggregates of the primary particles herein.

More specifically, the reason why the external additive filming cannot be effectively suppressed by just controlling the ten point height of roughness profile Rzjis is considered to be as follows. In the case where fine recesses and projections are present on the surface of the charging roller, the external additive composed of fine particles is likely to attach to the bottom of the recesses and around the projections, and is unlikely be removed even when a cleaning member for cleaning the surface of the charging roller is provided. However, the ten point height of roughness profile Rzjis is defined as a difference between the average of peak heights of the five highest portions in a measurement range and the average of valley depths of the five lowest portions in the measurement range. Therefore, it can be seen that the ten point height of roughness profile Rzjis is not suitable for measuring the degree of small unevenness related to the external additive filming.

Therefore, in the examples below, configurations that can maintain good image quality for a long period of time are realized by suppressing the external additive filming by defining the surface roughness of the charging roller from a plurality of viewpoints.

External Additive and External Additive Filming

External additive is a general term for referring to organic or inorganic fine particles added so as to attach the outer surfaces of toner particles. Typically, one or a plurality of kinds of external additives are added to a developer of an electrophotography apparatus to improve the fluidity by reducing the attraction between toner particles or to impart a function such as stabilizing charge retention of toner. Examples of particles used as an external additive include silica, titanium oxide, and silane compounds. The external additive is added to and agitated with toner particles formed by a polymerization method, a pulverizing method, or the like, and thus attaches to the surfaces of the toner particles by the effect of Coulomb's force, van der Waals force, or the like.

External additive filming refers to a phenomenon that the external additive peeled off from the surfaces of the toner particles is transferred from the image bearing member onto the surface of the charging roller and is gradually accumulated. However, particles transferred from the image bearing member onto the charging roller include matter other than the external additive such as wear debris of the photosensitive drum and paper dust, and it is possible that these particles are also accumulated on the surface of the charging roller together with the external additive. Therefore, in the present exemplary embodiment, "external additive filming" refers not only to the filming caused by only the external additive but also generally to filming phenomena caused by fine particles having smaller diameters than the average particle diameter of the toner.

Charging System

To be noted, as a method of charging an image bearing member by using a charging roller, a direct current charging system of applying a direct current voltage to the charging roller and an alternate current charging system of applying a voltage in which a direct current voltage and an alternate current voltage are superimposed on one another to the charging roller are known. Among these, in the alternate charging system, electrical discharge in positive and negative directions is repeated at a nip portion at which the image bearing member and the charging roller are charged, and thus the surface potential of the image bearing member settles at a target value. Therefore, according to the alternate charging system, abnormality of the surface shape of the charging roller, unevenness of resistivity, and the like are less likely to appear as image defects. In contrast, according to the direct current charging system, whereas the power source configuration can be simplified as compared with the alternate current charging system, unevenness occurs in the charging potential of the image bearing member and thus image defects are likely to occur in the case where abnormal electrical discharge is caused by abnormality of the surface shape of the charging roller or the like.

That is, the direct current charging system has a characteristic that the influence of external additive filming is more likely to appear as image defects than the alternate current charging system. Therefore, the configurations of charging rollers that will be described in Examples later can be suitably used for electrophotography apparatuses of direct current charging systems. However, since image defects also occur in the alternate current charging system when the external additive filming progresses, the charging rollers that will be described in Examples are also effective for electrophotography apparatuses of alternate current charging systems.

Durability of Image Bearing Member

In addition, in recent years, the durability of the image bearing member has improved by methods such as coating a surface layer of the photosensitive drum with a hard material. By using the charging rollers that will be described in Examples below in combination with an image bearing member having high durability, the lifetime of the cartridge as a whole including the image bearing member or the lifetime of the image forming apparatus as a whole can be extended, and thus the running cost can be reduced.

Examples of an image bearing member having high durability include the following photosensitive drum. A photosensitive layer containing organic photoconductor: OPC is formed on a drum base body of aluminum or the like, and an overcoat layer: OCL is formed on the outer periphery thereof as an outermost layer. The overcoat layer is formed from a resin material having higher wear resistance than the photosensitive layer. In addition, a process of improving the wear resistance by radiating electron beams after forming an overcoat layer containing a polymerizable compound may be performed.

To secure wear resistance of the photosensitive drum, it is preferable that the elastic deformation power of the surface of the photosensitive drum is 47% or more. To be noted, the elastic deformation power is obtained by performing an indentation test by a nanoindentation method defined in ISO 14577, and refers to a ratio of work of elastic deformation to the total work of indenter on a test piece. By setting the elastic deformation power within the range described above, the wear rate of the surface of the photosensitive drum on a rubbing surface of a cleaning blade of a drum cleaning unit or the like can be reduced.

First Exemplary Embodiment

Figure 2A:
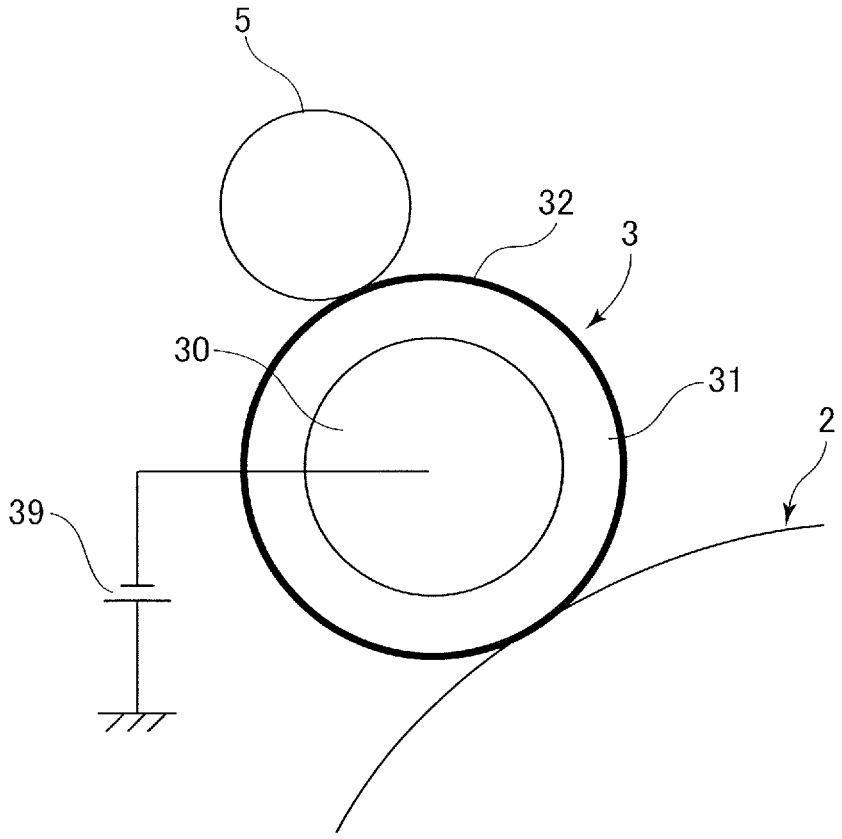
FIG. 2A is a schematic view of a charging roller included in the image forming apparatus.
Figure 2B:
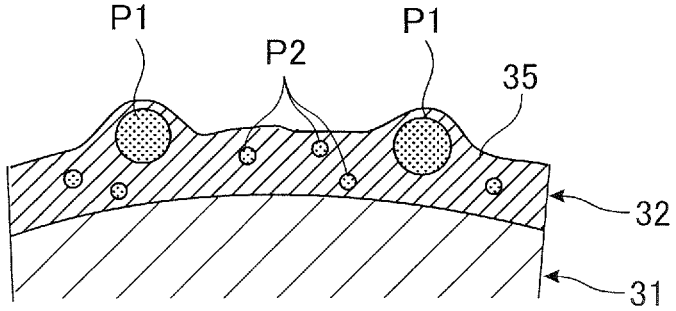
FIG. 2B is a schematic section view of a surface layer of the charging roller.

A charging roller according to a first exemplary embodiment will be described below. To be noted, "parts" indicating the amount of constituent material of a member is parts by mass in the description below. FIG. 2A is a section view of a charging roller 3 of this example, and FIG. 2B is a schematic section view of the surface layer. The charging roller 3 can be used as each of the charging rollers 3*a* to 3*d* of the image forming units 1*a* to 1*d* in the image forming apparatus 100.

The charging roller 3 is disposed to oppose a photosensitive drum 2, and is electrically connected to a charging power source 39 serving as a voltage application unit provided in the image forming apparatus 100. The charging power source 39 includes a voltage generation circuit that generates a direct current charging voltage, and applies the charging voltage to the charging roller 3 on the basis of a command from a controller of the image forming apparatus 100.

In addition, the charging roller 3 is used together with a charging cleaning member 5 if necessary. The charging cleaning member 5 is a member that removes soiling matter attached to the surface of the charging roller 3. Examples of the soiling matter include toner, external additives, wear debris of the photosensitive drum, and paper dust. As the charging cleaning member 5, for example, a rotary member having a brush shape or a sponge roller including a surface layer formed from a foam material can be used.

The charging roller 3 includes a support body 30, an elastic layer 31 formed on the outer periphery of the support body 30, and a surface layer 32 formed on the elastic layer 31. The support body 30 is a shaft member having excellent wear resistance and deflection stress, and one formed from steel plated with nickel can be used. The elastic layer 31 can be formed from a rubber, thermoplastic elastomer, or the like that is conventionally used for the elastic layer of a charging roller. Specifically, rubber compositions containing polyurethane, silicone rubber, butadiene rubber, isoprene rubber, chloroprene rubber, styrene-butadiene rubber, ethylene-propylene rubber, polynorbornene rubber, styrene-butadiene-styrene rubber, epichlorohydrine rubber, or the like as a base rubber, or thermoplastic elastomers can be used. The kinds of the rubber compositions and the thermoplastic elastomers are not particularly limited, and one or more thermoplastic elastomers selected from general-purpose styrene-based elastomers and olefin-based elastomers can be preferably used. In addition, depending on the required elasticity, solid rubber or foam rubber may be used.

Predetermined conductivity can be imparted to the elastic layer 31 by adding a conducting agent thereto. The conducting agent is not particularly limited, and examples thereof include cationic surfactants (such as quaternary ammonium salts like perchlorates, chlorates, fluoborates, ethosulfates, and benzyl halides such as benzyl bromides and benzyl chlorides of lauryltrimethylammonium, stearyltrimethylammonium, octadodecyltrimethylammonium, dodecyltrimethylammonium, and modified-fatty acid-dimethylethylammonium), anionic surfactants (such as aliphatic sulfonate salts, higher alcohol sulfate salts, higher alcohol ethylene oxide-added sulfate salts, higher alcohol phosphate salts, and higher alcohol ethylene oxide-added phosphate salts), amphoteric surfactants (such as betaines), antistatic agents (such as nonionic antistatic agents like higher alcohol ethylene oxides, polyethylene glycol fatty acid esters, and polyol fatty acid esters), salts of Group 1 metals (such as $Li^+$, $Na^+$, and $K^+$ such as $LiCF_3SO_3$, $NaClO_4$, $LiAsF_6$, $LiBF_4$, NaSCN, KSCN, and NaCl), electrolytes (such as $NH^{4+}$ salts), salts of Group 2 metals (such as $Ca^{2+}$ and $Ba^{2+}$ such as $Ca(ClO_4)_2$), and these antistatic agents including at least one group including active hydrogen that reacts with isocyanates (such as a hydroxyl group, a carboxyl group, or a primary or secondary amine group). Further, examples of the conducting agent include ionic conducting agents (such as complexes of the examples described above and polyols such as 1,4-butanediol, ethylene glycol, polyethylene glycol, propylene glycol, and polyethylene glycol) derivatives thereof, or the like, and complexes of the examples described above and monools (such as ethylene glycol monomethyl ether and ethylene glycol monoethyl ether), conductive carbons (such as ketjenblack EC and acetylene black), carbons for rubbers (such as SAF, ISAF, HAF, FEF, GPF, SRF, FT, and MT), carbons for color inks that have undergone oxidization treatment, pyrolytic carbons, natural graphite, artificial graphite, metals and metal oxides (such as antimony doped tin oxide, titanium oxide, zinc oxide, nickel, copper, silver, and germanium), and conductive polymers (such as polyaniline, polypyrrole, and polyacetylene). In this case, the content of these conducting agents is appropriately selected in accordance with the kind of the composition, and is normally adjusted such that the volume resistivity of the elastic layer 31 is $10^2$ to $10^8$ Ω·cm, and more preferably $10^3$ to $10^6$ Ω·cm.

The surface layer 32 is formed from a conductive resin layer 35 in which particles P1 and P2 are dispersed as illustrated in FIG. 2B. Specific examples of a resin material constituting the conductive resin layer 35 include polyester resin, acrylic resin, urethane resin, acrylic urethane resin, nylon resin, epoxy resin, polyvinyl acetal resin, vinylidene chloride resin, fluorine resin, and silicone resin, and either of organic and aqueous resins can be used. In addition, a conducting agent can be added to the surface layer 32 to impart conductivity to the surface layer 32 or adjust the conductivity of the surface layer 32. In this case, the conducting agent is not particularly limited, and examples thereof include conductive carbons (such as ketjenblack EC and acetylene black), carbons for rubbers (such as SAF, ISAF, HAF, FEF, GPF, SRF, FT, and MT), carbons for color inks that have undergone oxidization, pyrolytic carbons, natural graphite, artificial graphite, and metals and metal oxides (such as antimony doped tin oxide doped, titanium oxide, zinc oxide, nickel, copper, silver, and germanium). Further, in the case of using the conducting agent in an organic solvent, it is preferable that surface treatment such as silane coupling treatment is performed on the surface of the conducting agent in consideration of the dispersibility. In addition, the amount of addition of the conducting agent can be appropriately adjusted such that desired resistivity can be realized. It has been found that the charging is stable when the electrical resistivity of the surface layer 32 is higher than that of the elastic layer 31, therefore it is required that the volume resistivity is in the range of $10^3$ to $10^{15}$ Ω·cm, and more preferably in the range of $10^5$ to $10^{14}$ Ω·cm.

As the particles P1 and P2 added to this outermost conductive resin layer serving as the surface layer 32, urethane particles, nylon particles, acrylic resin particles, and copolymer resin particles such as acrylic styrene resin particles that are insulator particles having volume resistivity of $10^{10}$ Ω·cm or higher can be used. Other than these, silica particles and particles in which an inorganic material such as titanium oxide, zinc oxide, or tin oxide is bound by resin can be also used, and it is more preferable that pre-treatment such as silane coupling treatment is performed to improve the dispersibility similarly to the case of the conducting agent. In addition, although two kinds of particles having different particle diameters, that is, large particles P1 and small particles P2 are dispersed in the illustrated example, a single kind of particles or three or more kinds of particles may be dispersed. In addition, to control the surface texture as will be described later, for example, flat particles having low sphericity may be used.

Although how the charging roller described above is formed is not particularly limited, a method of preparing a coating material containing each component and applying this coating material by a dipping method, a spraying method, or a roller coating method to form a coating film is preferably used. In this case, when forming a plurality of outer layers, the dipping, spraying or roller coating may be repeated by using coating materials constituting the respective layers.

Description of Specific Manufacturing Method

Here, a specific method of manufacturing the charging roller 3 will be described. The manufacturing configuration that will be described below is the configuration of a charging roller of Example 1 in Table 1 that will be shown later, and although the outer diameter and content of particles therein are different from configuration examples of other charging rollers, the manufacturing method itself is the same.

First, regarding the preparation method for the elastic layer 31, 100 parts of epichlorohydrin rubber (product name: Epichlomer CG102, manufactured by Osaka Soda Co., Ltd.), 30 parts of calcium carbonate serving as filler, 2 parts of colored grade carbon (product name: Seast SO, manufactured by Tokai Carbon Co., Ltd.) serving as a reinforcing material for improving polishability, 5 parts of zinc oxide, 10 parts of dioctyl phthalate: DOP serving as a plasticizer, 3 parts of quaternary ammonium perchlorate represented by Formula (1) below, and 1 part of 2-mercaptobenzimidazole serving as an antiaging agent were kneaded for 20 minutes by an open roll kneader, then 1 part of a vulcanization accelerator DM, 0.5 part of a vulcanization accelerator TS, and 1 part of sulfur as a vulcanizing agent were further added to the system, and the system was further kneaded for 15 minutes by an open roll kneader. This was extruded into a tubular shape by a rubber extruder, then was cut, subjected to primary vulcanization for 40 minutes by water vapor of 160° C. in a vulcanizer, and thus a primary-vulcanized rubber tube for a conductive elastomer base layer was obtained.

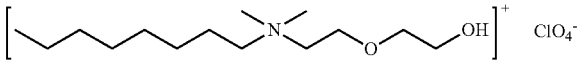

Next, a thermosetting adhesive (product name: Metaloc U-20) for metal and rubber was applied on a middle portion of a columnar surface of the support body 30 formed from steel, plated with nickel, and having a columnar shape in the axial direction thereof, and the support body 30 was dried for 30 minutes at 80° C. and then further for 1 hour at 120° C. This support body was inserted in the primary-vulcanized rubber tube for a conductive elastomer base layer, then secondary vulcanization and curing of the adhesive was performed by heating the tube and the support body for 2 hours at 160° C. in an electric oven, and thus an unpolished product was obtained. Both ends of a rubber part of the unpolished product were cut off, then the rubber part was polished by a grindstone, and thus a roller member including the elastic layer 31 having a ten point height of roughness profile Rzjis of 7 μm and a run-out of 25 μm was obtained.

Next, the surface layer 32 was formed. To 50 parts of conductive tin oxide powder (product name: SN-100P manufactured by Ishihara Sangyo Kaisha, Ltd.), 450 parts of 1% isopropyl alcohol solution of trifluoropropyltrimethoysilane and 300 parts of glass beads having an average particle diameter of 0.8 mm were added, dispersion of the system was performed for 48 hours by a paint shaker, and the dispersion was filtered by a net of 500 mesh. Next, this solution was heated in a 100° C. water bath while being stirred by a nauta mixer to volatilize and remove alcohol to dry the system, and surface-treated conductive tin oxide was obtained by adding a silane coupling agent to the surface of the system. Further, 145 parts of lactone-modified acrylic polyol (product name: Placcel DC2009, manufactured by Daicel Corporation, having a hydroxyl value of 90 KOHmg/g) was dissolved in 455 parts of methyl isobutyl ketone: MIBK to obtain a solution having solids of 24.17% by mass. With 200 parts of this acrylic polyol solution, 50 parts of the surface-treated conductive tin oxide powder, 0.01 part of silicone oil (product name: SH-28PA, manufactured by Toray Dow Corning Silicone Co, Ltd.), 1.2 parts of fine silica particles having a primary particle diameter of 0.02 μm, 4.5 parts of large-diameter particles (product name: Chemisnow MX-1000 manufactured by Soken Chemical & Engineering Co., Ltd., having an average particle diameter of 10 μm), and 18 parts of small-diameter particles (product name: Chemisnow MX-500 manufactured by Soken Chemical & Engineering Co., Ltd., having an average particle diameter of 5 μm) were mixed. To this, 200 parts of glass beads having a diameter of 0.8 mm was added, and dispersion of the system was performed for 12 hours in a 450-ml mayonnaise jar by using a paint shaker while cooling.

Further, to 330 parts of this dispersion, 27 parts of block-type isocyanurate trimer of isophorone diisocyanate: IPDI (product name: Vestanat B1370, manufactured by Degussa-Hüls), and 17 parts of isocyanurate trimer of hexamethylene diisocyanate: HDI (product name: Duranate TPA-B80E, manufactured by Asahi Kasei Corp.) were added, the mixture was stirred for 1 hour by a ball mill, finally the solution was filtrated by a net of 200 mesh, and thus a coating material for surface layer having a solid content of 43% by mass was obtained. The coating material for surface layer was applied on the surface of the roller member including the elastic layer 31 by dipping. The application was performed at a pulling speed of 400 mm/min, and then the layer was air-dried for 30 minutes. After this, the axial direction was reversed, and the application was performed again at a pulling speed of 400 mm/min. Then, the layer was air-dried for 30 minutes and (hied for 1 hour in an oven at 160° C., and then the layer s left to stand for 48 hours in an environment of a room temperature of 25° C. and a relative humidity of 50%.

Examples of Configurations of Charging Roller

Table 1 show configuration examples of charging rollers of the present exemplary embodiment and test results of the charging rollers.

TABLE 1

| | | | Sample No. | | | | | | | | |
|---|---|---|---|---|---|---|---|---|---|---|---|
| | | | 1 | 2 | 3 | 4 | 5 | 6 | 7 | 8 | 9 |
| Configuration | | Large particle diameter D1 [μm] | 5 | 5 | 10 | 15 | 20 | 30 | 10 | 15 | 10 |
| | | Small particle diameter D2 [μm] | — | — | 5 | 5 | 5 | 5 | — | 5 | 5 |
| | | D1/D2 | — | — | 2.0 | 3.0 | 4.0 | 6.0 | — | 3.0 | 2.0 |
| | | Large particle mixture ratio M1/(M1 + M2) | 1.00 | 1.00 | 0.08 | 0.08 | 0.15 | 0.22 | 1.00 | 0.27 | 0.60 |
| | | Amount of mixed particles (M1 + M2)/M0 | 25.0% | 42.0% | 12.0% | 64.0% | 38.0% | 38.0% | 34.0% | 38.0% | 23.6% |
| Measured value | | Average film thickness [μm] | 12 | 7 | 15 | 15 | 15 | 15 | 12 | 15 | 15 |
| | | Spk + Sk [μm] | 2.5 | 3.5 | 4.5 | 7.3 | 8.7 | 8.9 | 3.7 | 7.3 | 7.0 |
| | | Svk [μm] | 0.4 | 1.2 | 0.6 | 1.4 | 0.9 | 0.6 | 1.1 | 0.9 | 0.6 |
| Image evaluation | Initial | Black dot (HT uniformity) | A | A | A | B | D | D | A | B | B |
| | After endurance test | White streak (toner soiling) | D | D | A | A | A | A | D | A | A |
| | | Black streak (external additive soiling) | A | D | A | D | B | A | C | B | A |

In the table, the items of respective rows represent the following.

"Large particle diameter D1" and "Small particle diameter D2" respectively represent average particle diameters of particles dispersed in the surface layer of the charging roller in the unit of D1 corresponds to the larger particles, and D2 corresponds to smaller particles. The larger particles and the smaller particles will be referred to as large particles and small particles. To be noted, in the present exemplary embodiment, the average particle diameters are volume average particle diameters.

"D1/D2" is a ratio of the large particle diameter to the small particle diameter.

"Large particle mixture ratio" represents a mass ratio of the large particles to all the particles dispersed in the surface layer. That is, in the case where M1 represents the mass of the mixed large particles and M2 represents the mass of the mixed small particles, "Large particle mixture ratio" is M1/(M1+M2).

"Amount of mixed particles" represents the amount of all the mixed particles with respect to all the solid components in the surface layer excluding the particles by percentage. That is, in the case where a value obtained by subtracting the masses M1 and M2 of the mixed large and small particles from the total mass of the surface layer 32 is M0, the amount of mixed particles is (M1+M2)/M0×100(%).

To be noted, in the case where only a single kind of particles is mixed, the calculation regarding the large particle mixture ratio and the amount of mixed particles was performed by setting D2 and M2 to 0.

"Average film thickness" in the table represents the layer thickness of the resin material constituting the surface layer. In other words, the average film thickness represents the average thickness of the solid components of the surface layer of the charging roller in the case of ignoring projecting portions on the surface derived from the particles. The projecting portions will be also referred to as particle portions hereinbelow. Specifically, a prototype of the surface layer of the charging roller was partially cut off, and the cut-off portion was observed by a laser microscope in a direction perpendicular to the section thereof at an appropriate magnification. The laser microscope used herein was VK-X1000 manufactured by KEYENCE. Then, the average distance from an interface between the surface layer and the elastic layer to the surface of the surface layer measured by excluding the projecting portions of the surface layer derived from the particles was set as the film thickness measured in this section. To reduce the deviation of measured value depending on the observed position, the observation was performed for 9 sections. The 9 sections are respectively taken at 3 different points in the longitudinal direction and 3 different points in the rotational direction of one charging roller. The 3 different points in the longitudinal direction were respectively at the center of the charging roller in the longitudinal direction and at positions 2 cm from both end portions of the charging roller in the longitudinal direction. The 3 different points in the rotational direction were set with 120° intervals therebetween from an arbitrary position as a standard. Then, the average of film thicknesses obtained for respective sections were set as the "average film thickness" of the surface layer of the charging roller.

To be noted, in the observation of sectional images described above, the range of the "particle portions" can be determined by visual observation in the case where the boundary between the particle portions and the other portion, that is, the base portion, is clear. In the case where the boundary is not clear, a roughness profile of the surface of the surface layer is obtained from the sectional images by a method defined in JIS B0601 or ISO 4278, and portions higher than a peak value of a height frequency distribution are regarded as particle portions. In the case where a plurality of peaks are present, the lowest peak value is used.

Measurement Method for Surface Texture of Charging Roller

The reduced peak height Spk, the core height Sk, and the reduced dale height Svk whose units are each μm were obtained by the following method. First, an image of the surface of the charging roller was captured by the laser microscope VK-X100 manufactured by KEYENCE with an objective lens of 50× magnification, thus three-dimensional height data having an area of 273 μm (width)×204 μm (length) was obtained, and autocorrection was performed on the curvature of the surface. Then, the reduced peak height Spk, the core height Sk, and the reduced dale height Svk were obtained by using a multi-file analysis application conforming to ISO 25178 manufactured by KEYENCE. To reduce the deviation of measured value depending on the observed position, 9 images were captured at 9 positions per one charging roller. The 9 images were respectively taken at 3 different points in the longitudinal direction and 3 different points in the rotational direction. The 3 different points in the longitudinal direction were respectively at the center of the charging roller in the longitudinal direction and at positions 2 cm from both end portions of the charging roller in the longitudinal direction. The 3 different points in the rotational direction were set with 120° intervals therebetween from an arbitrary position as a standard. Then, average values of values calculated for the respective images were set as the reduced peak height Spk, the core height Sk, and the reduced dale height Svk that were related to the surface roughness of the charging roller.

Here, a measurement method of a non-contact surface roughness tester conforming to ISO 25178 will be described. First, the tester scans the surface of a measurement target and thus obtains height data of M pixels (vertical)×N pixels (horizontal). A cumulative frequency distribution of the height data of the pixels is calculated in the order from the larger height to the smaller height. By this process, a curve whose vertical axis represents the height of the surface and whose horizontal axis represents an area ratio corresponding to the height is obtained. This curve is called a "material ratio curve", and the area of a region corresponding to a height of c or more is defined as an areal material ratio of the height of c. The highest position of the surface serving as a measurement target is a height corresponding to an areal material ratio of 0%, and the lowest position is a height corresponding to an areal material ratio of 100%.

Next, a middle portion of the material ratio curve is determined, and an equivalent straight line is defined. The middle portion of the material ratio curve is a section from an areal material ratio of X % to an areal material ratio of (X+40)%. The value of X is such a value that the inclination of a secant connecting a point of the areal material ratio of X % and a point of the areal material ratio of (X+40)% on the material ratio curve is the smallest, in a range from X=0 to X=60. In addition, the equivalent straight line is such a straight line that sum of squares of deviation thereof in the vertical axis direction, that is, the height direction of the surface, with respect to the middle portion of the material ratio curve is the smallest.

Further, the reduced peak height Spk, the core height Sk, and the reduced dale height Svk are calculated by using the equivalent straight line. The core height Sk is a difference between a height h1 of an intersection point where the equivalent straight line intersects a straight line of the areal material ratio of 0% and a height h2 of an intersection point where the equivalent straight line intersects a straight line of the areal material ratio of 100%. A portion corresponding to a section from the height h1 to the height h2 is a core surface, a portion higher than the height h1 corresponds to reduced peaks, and a portion lower than the height h2 corresponds to reduced dales.

The reduced peak height Spk is obtained as the height of a right triangle having an area equivalent to a volume V1 of the reduced peaks in the graph plane of the material ratio curve. Here, the volume V1 of the reduced peaks is an area of a region enclosed by the material ratio curve, a straight line of the height h1, and a straight line of the areal material ratio of 0% in the graph plane, and the length of the base of the right triangle is an areal material ratio Smr1 of the material ratio curve at the height h1. The reduced peak height Spk is determined such that Smr1×Spk/2=V1 is satisfied. The reduced peak height Spk represents an ordinary height of vertices of the reduced peaks with respect to the core surface.

Similarly, the reduced dale height Svk is obtained as the height of a right triangle having an area equivalent to a volume V2 of the reduced valleys in the graph plane of the material ratio curve. Here, the volume V2 of the reduced dales is an area of a region enclosed by the material ratio curve, a straight line of the height h2, and a straight line of the areal material ratio of 100% in the graph plane, and the length of the base of the right triangle is an areal material ratio Smr2 of the material ratio curve at the height h2. The reduced dale height Svk is determined such that Smr2×Svk/2=V2 is satisfied. The reduced dale height Svk represents an ordinary depth of bottoms of the reduced dales with respect to the core surface.

Endurance Test of Charging Roller and Evaluation Method Therefor

Next, how an endurance test of the charging roller was performed and an electrophotography apparatus used for image evaluation will be described. An electrophotographic copier used in this test was a machine for A3 horizontal output, the output speed of the recording material is 240 mm/sec, and the image resolution was 600 dpi. The image bearing member was a photosensitive drum of a reversal development system formed by coating an aluminum cylinder with an OPC layer and further coating the OPC layer with an overcoat layer. Grinded toner that had an average diameter of 6 μm, contained polyester as a main material and wax as an inner additive, and had been treated with an external additive such as silica was used as the toner. To evaluate the image after the endurance test, the copier was caused to successively output an image of an image ratio of 5% on 100 thousand sheets in an environment of low temperature and low humidity, that is, an L/L environment of 15° C. and 10% RH.

Regarding image evaluation, first, presence/absence of an image defect called black dot in a halftone image output in an initial state, that is, the uniformity of the halftone image was evaluated. The uniformity of the halftone image will be also referred to as HT uniformity. The black dot is observed in the case where, for example, the particles in the surface layer of the charging roller are too large or where the particles are not successfully dispersed and aggregates are formed, and thus serves as an index for determining whether the amount of addition of the particles is too large. It is assumed that a portion that discharges electricity and a portion that does not discharge electricity are locally formed, thus a portion having a relatively high potential and a portion having a relatively low potential are generated, and the portion having a relatively low potential appears as a prominently black portion. That is, in the case of a direct current charging system, when the sum of a reduced peak height Spk and a core height Sk is larger than 8 μm, no electrical discharge occurs because a contact nip portion between the charging roller and the photosensitive drum is equal to or smaller than 8 μm, which is the minimum gap through which Paschen discharge occurs. However, it is considered that, in the case where the degree of dispersion of the particles in the surface layer is small, the gap width exceeds 8 μm at some parts, thus an area where electrical discharge occurs increases, and locally the portion that discharges electricity and the portion that does not discharge electricity are generated.

Regarding the evaluation criteria of the black dot, a halftone image of A3 size was output on one sheet, and presence/absence of a black dot image was checked. A case where no black dot was generated was evaluated as "A", a case where the number of black dots was 4 or less and the sizes of the black dots were 0.3 mm or smaller was evaluated as "B", and a case where the number of black dots was 20 or less and the sizes of the black dots were 0.6 mm or smaller was evaluated as "C". In addition, a case where the sizes of black dots were larger than 0.6 mm or where the sizes of the black dots were equal to or smaller than 0.4 mm but the number of the black dots was more than 20 was evaluated as "D".

Next, regarding evaluation of the nonuniformity appearing as a streak shape, after the endurance test of the copier, that is, after outputting an image on 100 thousand sheets in the above conditions, the evaluation was performed by visually checking a halftone image. A case where no image defects of the streak occurred on the halftone image was evaluated as "A", a case where nonuniformity that was so subtle and could not be noticed without close observation occurred was evaluated as "B", a case where nonuniformity that was minor but could be recognized at a glance occurred was evaluated as "C", and a case where nonuniformity that clearly stood out occurred was evaluated as "D". In addition, it was determined that a streak of low density, that is, white streak on the halftone image was caused by toner filming and that a streak of high density, that is, black streak was caused by external additive filming. This is because the inventors found, from the results of other experiments, that the direction in which the charging potential changes differs depending on the cause of the filming in either case of a direct current charging system and an alternate current charging system.

In the case of the external additive filming, an experimental result indicating that the charging potential changes in a direction in which the absolute value thereof becomes smaller, that is, a direction in which the image density increases was obtained. In contrast, in the case of toner filming of the direct current charging system, the charging potential changes in a direction in which the absolute value thereof becomes larger, that is, a direction in which the image density decreases. To be noted, in the case of toner filming of the alternate current charging system, the charging potential changes in a direction in which the absolute value thereof becomes smaller due to soiling by the external additive, that is, a direction in which the image density increases, similarly to the case of the external additive filming. The reason why the effect on image changes depending on which of the external additive filming and the toner filming the filming is in the direct current charging system is not known. The reason why the absolute value of the charging potential decreases due to filming in the alternate current charging system is considered to be that an impedance Z increases due to the attached matter and the charging efficiency of the filming portion decreases. In addition, it is possible that the reason why the absolute value of the charging potential increases due to toner filming in the direct current charging system is occurrence of local abnormal electrical discharge.

Evaluation Results

Table 1 showing the results of evaluation obtained by the evaluation method described above will be described. First, a charging roller coated with a surface layer having an average film thickness of 12 μm in which a single kind of particles having an average particle diameter of 5 μm was mixed such that the mixture ratio thereof to all the solid components in the surface layer was 25% was manufactured as Example 1. The surface roughness of Example 1 was measured. As a result, the sum Spk+Sk of the reduced peak height Spk and the core height Sk was 2.5 and the reduced dale height Svk was 0.4 This charging roller was attached to a copier and the copier was caused to output a halftone image. As a result, no black dot was observed, and thus the evaluation concerning a black dot was "A". As a result of further outputting a halftone image after the endurance test of outputting 100 thousand sheets, no black streak was observed, and thus the evaluation concerning a black streak was "A". However, a white streak was observed and thus the evaluation concerning a white streak was "D". From these results, it was assumed that toner filming occurred in Example 1 due to low surface roughness.

Next, a charging roller coated with a surface layer having an average film thickness of 7 μm in which a single kind of particles having an average particle diameter of 5 μm was mixed such that the mixture ratio thereof to all the solid components in the surface layer was 42% was manufactured as Example 2. The surface roughness of Example 2 was measured. As a result, Spk+Sk was 3.5 and Svk was 1.2 This means that, as a result of the film thickness of the surface layer decreasing, the amount of projection of the particle portions increased and the height of peaks slightly increased, but depths of fine valleys also increased. The same evaluation as Example 1 was performed on Example 2. As a result, the evaluation concerning a black dot in an initial state was "A", but the evaluation concerning a white streak and the evaluation concerning a black streak were both "D". From these results, it was confirmed that the filming of toner and an external additive is not likely to be suppressed when it is attempted to increase the surface roughness by reducing the film thickness of the surface by just using a single kind of particles having a small diameter. In addition, a tendency that the external additive filming became worse when the value of Svk increased was observed.

Therefore, to resolve both problems, a method of dispersing two kinds of particles having different diameters to separate functions respectively addressing the toner filming and the external additive filming was conceived. Specifically, image evaluation was performed on configuration examples in which variables such as an average particle diameter D1 of large particles, a mixture amount M1 thereof, an average particle diameter D2 of small particles, and a mixture amount M2 thereof were changed, to find an optimum value for each variable.

First, a combination of a large particle diameter D1 of 10 μm and a small particle diameter D2 of 5 μm was chosen. In addition, a charging roller coated with a surface layer having an average film thickness of 15 μm in which the large particle mixture ratio was 0.08 and the amount of mixed particles was 12% with respect to all the solid components in the surface layer was manufactured as Example 3. The surface roughness of Example 3 was measured. As a result, Spk+Sk was 4.5 μm and Svk was 0.6 The same evaluation as Example 1 was performed on Example 3. As a result, the evaluation concerning a black dot in an initial state, and the evaluation concerning a white streak and the evaluation concerning a black streak after the evaluation test were all "A". These results suggest that Spk+Sk has a correlation with white streaks and that there is a possibility that a lower limit threshold thereof is between 3.5 μm and 4.5 μm. In addition, although there is a possibility that 0.4 μm is too small and 1.2 μm is too large for the value of Svk, the thresholds cannot be determined from experimental results obtained so far.

Next, a charging roller having a surface layer having an average film thickness of 15 μm was manufactured as Example 4 by using a combination of a large particle diameter D1 of 15 μm, a small particle diameter D2 of 5 μm, a large particle mixture ratio of 0.08, and an amount of mixed particles of 64% with respect to all the solid components in the surface layer. The surface roughness of Example 4 was measured. As a result, Spk+Sk was 7.3 μm and Svk was 1.4 μm. Then, Example 4 was evaluated. As a result, the evaluation concerning a black dot in an initial state was "B", and, after the endurance test, no white streak was observed and the evaluation concerning a white streak was "A", but a black streak was observed and the evaluation concerning a black streak was "D". These results suggest a possibility that the black streak caused by the external additive filming depends on the value of Svk, and the black streak is generated when the value of Svk is larger than 1.2 μm.

Next, a charging roller having a surface layer having an average film thickness of 15 μm was manufactured as Example 5 by using a combination of a large particle diameter D1 of 20 μm, a small particle diameter D2 of 5 μm, a large particle mixture ratio of 0.15, and an amount of mixed particles of 38% with respect to all the solid components in the surface layer. The surface roughness of Example 5 was measured. As a result, Spk+Sk was 8.7 μm and Svk was 0.9 μm. Then, Example 5 was evaluated. As a result, the evaluation concerning a black dot in an initial state was "D", but after the endurance test, no white streak or black streak was observed, and the evaluation thereof was both "A". These results suggest a possibility that the value of Svk+Sk exceeding a certain upper limit is a cause of occurrence of the black dot, and it was found that the threshold thereof is between 7.3 μm and 8.7 μm.

Next, a charging roller having a surface layer having an average film thickness of 15 μm was manufactured as Example 6 by using a combination of a large particle diameter D1 of 30 μm, a small particle diameter D2 of 5 μm, a large particle mixture ratio of 0.22, and an amount of mixed particles of 38% with respect to all the solid components in the surface layer. The aim for this is to check whether or not the evaluation concerning a black dot is improved by reducing the amount of large particles and increasing the diameter of the large particles instead. The surface roughness of Example 6 was measured. As a result, Spk+Sk was 8.9 μm and Svk was 0.6 μm. In addition, in Example 6, the evaluation concerning a black dot in an initial state was "D", but after the endurance test, no white streak or black streak was observed, and the evaluation thereof was both "A".

From the results of Examples 4, 5, and 6, it was found that the average particle diameter of the large particles is preferably 15 μm or smaller for a black dot to not be generated. In addition, to make the value of Spk+Svk be 4 μm or larger, which is a value that can effectively suppress the toner filming, by using such particles, it is preferable that the particles are not completely buried in the resin material constituting the surface layer and at least partially project from the resin layer. For example, in the section of the surface layer described in the measurement method for the average film thickness of the surface layer, at least part of the particles project to the outer periphery side preferably by 4 μm or more and more preferably 5 μm or more from a height position calculated as the film thickness of the surface layer. In addition, mixing particles having an average particle diameter of 2 μm to 15 μm while limiting the average film thickness of the surface layer to 20 μm or smaller was effective for securing the amount of projection of the particles.

In addition, as can be seen from the result of Example 6 having a large amount of mixed particles with respect to the solid components of the surface layer that the reduced dale height Svk increased and the external additive filming occurred as a result, it is preferable that the amount of mixed particles with respect to the solid components of the surface layer is not too large, for example, 50% or smaller. Further, it was found that a good result is obtained in the case where, the average particle diameters D1 and D2 of the large particles serving as first particles and small particles serving as second particles satisfy $5<D1<20$ and $3<D2\leq(D1)/2$.

Next, to confirm the difference between the case of a single kind of particles and the case of two kinds of particles, a charging roller having a surface layer of an average film thickness of 12 μm was manufactured as Example 7 by mixing a single kind of particles having an average particle diameter of 10 μm in the surface layer such that the mass ratio thereof to all the solid components in the surface layer was 34%. The surface roughness of Example 7 was measured. As a result, Spk+Sk was 3.7 μm, and Svk was 1.1 μm. As a result of evaluating Example 7, the evaluation concerning a black dot in an initial state was "A", but the evaluation concerning a white streak was "D" and the evaluation concerning a black streak was "C". From these results, it was found that the toner filming becomes worse in the case where Spk+Sk is smaller than 4.0 μm. In addition, it was found that the external additive filming becomes worse in the case where Svk is larger than 1.0 μm.

Next, a charging roller having a surface layer having an average film thickness of 15 μm was manufactured as Example 8 by using a combination of a large particle diameter D1 of 15 μm, a small particle diameter D2 of 5 μm, a large particle mixture ratio of 0.27, and an amount of mixed particles of 38% with respect to all the solid components in the surface layer. The aim for this is to check the upper limit value of acceptable ranges of the variables in the case where the amount of particles is further increased from Example 3. The surface roughness of Example 8 was measured. As a result, Spk+Sk was 7.3 μm and Svk was 0.9 μm. In addition, the evaluation concerning a black dot in an initial state was "B", and after the endurance test, the evaluation concerning a white streak was "A" and the evaluation concerning a black streak was "B". From these results, it still can be seen that Spk+Sk needs to be 8 μm or smaller and Svk needs to be 1.0 μm or smaller.

Next, a charging roller having a surface layer having an average film thickness of 15 μm was manufactured as Example 9 by using a combination of a large particle diameter D1 of 10 μm, a small particle diameter D2 of 5 μm, a large particle mixture ratio of 0.60, and an amount of mixed particles of 23.6% with respect to all the solid components in the surface layer. The surface roughness of Example 9 was measured. As a result, Spk+Sk was 7.0 μm and Svk was 0.6 μm. In addition, the evaluation concerning a black dot in an initial state was "B", and after the endurance test, no white streak or black streak was observed, and the evaluation thereof was both "A". From these results, it was found that a charging roller having good results on all of black dots, white streaks, and black streaks can be manufactured, even in the case where the average particle diameter of the large particles is reduced, by maintaining the values of Spk+Sk and Svk while increasing the amount of large particles.

As described above, according to the examples, it was found that it is important that values of the reduced peak height Spk, the reduced dale height Svk, and the core height Sk related to surface roughness of the charging roller and obtained by a measurement method conforming to ISO 25178 satisfy predetermined ranges. That is, in the case where these variables satisfy 4≤Spk+Sk≤8 and 0.4≤Svk≤1, the uniformity of charging potential can be secured, and occurrence of toner filming and external additive filming can be suppressed. In addition, preferably, in the case where these variables satisfy 4≤Spk+Sk≤8 and 0.5≤Svk≤1, the uniformity of charging potential can be secured, and occurrence of toner filming and external additive filming can be suppressed. As a result of this, it has become possible to provide a charging roller capable of maintaining a good image quality for a long period of time. Such a charging roller can be preferably used with a developer including a toner having an average particle diameter of 10 μm or smaller and an external additive having an average particle diameter serving as primary particle diameter of 0.5 μm or smaller in an electrophotography apparatus.

In addition, from the results of tests described above, it was found that better evaluation can be obtained in the case where relationships of Spk+Sk<7.0 and Svk<0.9 are satisfied as can be seen from Examples 3, 8, and 9 of Table 1.

Second Exemplary Embodiment

Next, a charging roller according to a second exemplary embodiment will be described. In the present exemplary embodiment, unlike the first exemplary embodiment, the surface texture of the charging roller is defined by using parameters of line roughness.

As described above, the external additive filming cannot be effectively suppressed by just defining the ten point height of roughness profile Rzjis, and the reason for this is considered to be because the external additive, which is constituted by finer particles than toner particles, is attracted to fine recesses on the surface of the charging roller. In addition, it is considered that the external additive attracted to the fine recesses slips through the cleaning by the charging cleaning member, and thus is likely to remain on the surface of the charging roller. Therefore, in the present exemplary embodiment, the surface roughness of a base portion of the surface of the charging roller, which is a portion excluding the particle portions from the entirety of the surface, is defined in addition to the surface roughness of the entirety of the surface of the charging roller.

Examples of Configurations of Charging Roller

Table 2 shows configuration examples of charging rollers of the present exemplary embodiment and test results of the charging rollers.

TABLE 2

| | | Sample No. | | | | | | | |
|---|---|---|---|---|---|---|---|---|---|
| | | 1 | 2 | 3 | 4 | 5 | 6 | 7 | 8 |
| Configuration | Large particle diameter D1 [μm] | 5 | 5 | 10 | 15 | 30 | 15 | 10 | 10 |
| | Small particle diameter D2 [μm] | — | — | 5 | 5 | 5 | 5 | 5 | — |
| | D1/D2 | — | — | 2.0 | 3.0 | 6.0 | 3.0 | 2.0 | — |
| | Large particle mixture ratio M1/(M1 + M2) | 1.00 | 1.00 | 0.08 | 0.27 | 0.22 | 0.08 | 0.60 | 1.00 |
| | Amount of mixed particles (M1 + M2)/M0 | 25.0% | 42.0% | 12.0% | 38.0% | 38.0% | 64.0% | 23.6% | 53.4% |
| Measured value | Average film thickness [μm] | 7 | 12 | 15 | 15 | 15 | 15 | 15 | 15 |
| | Ten point height of roughness | 3.4365 | 8.471 | 13.346 | 19.597 | 22.922 | 19.044 | 18.145 | 2.7695 |

TABLE 2-continued

| | | | Sample No. | | | | | | | |
|---|---|---|---|---|---|---|---|---|---|---|
| | | | 1 | 2 | 3 | 4 | 5 | 6 | 7 | 8 |
| | | profile Rz1 of entire surface | | | | | | | | |
| | | Ten point height of roughness profile Rz2 of base portion | 0.3036 | 1.048 | 0.941 | 0.9365 | 0.858 | 2.0085 | 1.259 | 0.1745 |
| Image evaluation | Initial | Black dot (HT uniformity) | A | A | A | B | D | B | B | A |
| | After endurance test | White streak (toner soiling) | D | D | A | A | A | A | A | D |
| | | Black streak (external additive soiling) | A | B | B | B | B | D | C | A |

The definition of items "Large particle diameter D1", "Small particle diameter D2", "D1/D2", "Large particle mixture ratio", and "Amount of mixed particles" in Table 2 is the same as in the first exemplary embodiment. In addition, the definition and measurement method for "Average film thickness" are also the same as in the first exemplary embodiment.

Measurement Method for Surface Roughness of Charging Roller

In Table 2, Rz1 and Rz2 are each ten point height of roughness profile defined in Japanese Industrial Standards JIS B0601 (1994) and Appendix JA of JIS B0601 (2013). Rz1 is a ten point height of roughness profile of the surface of the charging roller including the particle portions serving as projections. Rz2 is a ten point height of roughness profile of the base portion excluding the particle portions. The base portion will be also referred to as a sea portion. Hereinafter, Rz1 and Rz2 will be distinguished from each other by referring to Rz1 as "Ten point height of roughness profile of the entire surface" and Rz2 as "Ten point height of roughness profile of the base portion".

The ten point height of roughness profile Rz1 was obtained by the following method. First, an image of the surface of the charging roller was captured by the laser microscope VK-X1000 manufactured by KEYENCE with an objective lens of 50× magnification, and thus two-dimensional height data having an area of 273 μm (width)× 204 μm (length) was obtained. After performing autocorrection on the curvature of the surface, an average value of ten point heights of roughness profiles of 3 different points in the circumferential direction set with 120° intervals therebetween from an arbitrary position was obtained by using a multi-file analysis application manufactured by KEYENCE. This average value was used as the ten point height of roughness profile Rz1 of the entire surface of the charging roller.

In addition, the ten point height of roughness profile Rz2 of the base portion was also calculated from two-dimensional height data obtained by capturing an image of the surface of the charging roller by the same laser microscope with an objective lens of 50× magnification and performing autocorrection on the curvature of the surface. Here, to distinguish the particle portions from the base portion, a height frequency distribution of the two-dimensional height data was generated, and binarization was performed with reference to a peak of the histogram. In the case where a plurality of peaks were present, a peak value on the lower limit side was used as the reference. A portion higher than the peak value was excluded from the original two-dimensional height data, and the remainder was regarded as the base portion. With an image representing the tow-dimensional height data after the binarization displayed on a monitor, 10 regions of 10 μm (width)×10 μm (length) were selected while checking the position of the base portion, and an average value of ten point heights of roughness profiles calculated for the respective regions was obtained. In addition, to reduce the deviation of measured value depending on the observed position, 9 images were captured at 9 positions per one charging roller. The 9 images were respectively taken at 3 different points in the longitudinal direction and 3 different points in the rotational direction. The 3 different points in the longitudinal direction were respectively at the center of the charging roller in the longitudinal direction and at positions 2 cm from both end portions of the charging roller in the longitudinal direction. The 3 different points in the rotational direction were set with 120° intervals therebetween from an arbitrary position as a standard. Then, the average value of ten point heights of roughness profiles of the base portion obtained for the respective images was used as the ten point height of roughness profile Rz2 of the base portion of the charging roller.

Endurance Test of Charging Roller and Evaluation Method Therefor

How an endurance test of the charging roller was performed and an electrophotography apparatus used for image evaluation will be described. The configuration of the electrophotographic copier, the composition of the toner, and the number of sheets output in the endurance test used in this test were the same as in the first exemplary embodiment. In addition, the image evaluation was performed on the presence/absence of black dots, that is, the uniformity of the halftone image, and nonuniformity appearing as streak shapes, that is, white streaks and black streaks, similarly to the first exemplary embodiment, and the same evaluation criteria as the first exemplary embodiment were used.

Evaluation Results

Table 2 showing the results of evaluation obtained by the evaluation method described above will be described. First, a charging roller coated with a surface layer having an average film thickness of 7 μm in which a single kind of particles having an average particle diameter of 5 μm was mixed such that the mixture ratio thereof to all the solid components in the surface layer was 25% was manufactured as Example 1. The charging roller manufactured in this configuration was attached to a copier and the copier was caused to output a halftone image, as a result, no image defect of black dot was observed, and thus the evaluation concerning a black dot was "A". As a result of further outputting a halftone image after the endurance test of outputting 100 thousand sheets, no black streak was observed, and thus the evaluation concerning a black streak was "A". However, a white streak was observed and thus the evaluation concerning a white streak was "D".

Here, to measure the effect of the particles, charging rollers of Examples 3 to 5 containing particles having larger particle diameters than 5 μm were manufactured in addition to a charging roller of Example 2 in which the average particle diameter of a single kind of particles was set to 5

μm. In Example 3, the large particle diameter D1 was set to 10 μm. In Example 4, the large particle diameter D1 was set to 15 μm. In Example 5, the large particle diameter D1 was set to 30 μm. In these configuration examples, it was confirmed that there is a correlation between the ten point height of roughness profile Rz1 of the entire surface and the large particle diameter D1.

As a result of performing image evaluation on Examples 2 to 5, there was a tendency that the image defect of black dot became worse as the ten point height of roughness profile Rz1 of the entire surface became larger. In Examples 2, 3, and 4 in which Rz1 was smaller than 20 μm, no image defect of black dot was observed and therefore the evaluation concerning a black dot was "B" or better. However, in Examples 5 in which Rz1 was larger than 20 μm, the evaluation concerning a black dot was "D". Meanwhile, according to the evaluation of the halftone image after the endurance test, the image defect of white streak caused by toner filming became better than Example 1, and thus the evaluation concerning a white streak became "A" in Examples 3, 4, and 5. However, the evaluation concerning a white streak was "D" in Example 2. That is, it was suggested that there is a trade-off relationship that, when the ten point height of roughness profile Rz1 of the entire surface is increased by increasing the diameter of the particles, the toner filming is suppressed, but the uniformity of the initial halftone image is degraded.

Here, the evaluation concerning soiling of a black streak shape was "B" or better in all of Examples 2 to 5. Observing these charging rollers by an optical microscope, it was assumed that some portions in which particles aggregate are causes of deterioration of a halftone image and fine undulation and wrinkles on the surface are causes of deterioration of the external additive filming.

Next, to measure the influence of the fine undulation and wrinkles of the surface of the charging roller on the external additive filming, charging rollers of Examples 6 to 8 were manufactured. For the charging rollers of Examples 6 to 8, the composition or the manufacturing method was changed from the configuration of the manufacturing method of Example 1 such that the ten point height of roughness profile Rz2 of the base portion was changed. Regarding the changed points, the large particle diameter D1 or the small particle diameter D2 and the amount of mixed particles shown in Table 2 were changed, and a method of changing the degree of dispersion of the particles in the paint for surface layer or a method of changing the volatility of the paint for surface layer after being applied on the elastic layer was used. The ten point height of roughness profile Rz2 of the base portion was about 2.00 μm in Example 6, about 1.26 μm in Example 7, and about 0.17 μm in Example 8.

Image evaluation was performed on Examples 6 to 8, and as a result, there was a tendency that the image defect of black streak became worse as the ten point height of roughness profile Rz2 of the base portion increased. In Example 6 in which Rz2 was 2.00 μm, the image defect of black streak became worse and the evaluation thereof was "D". In Example 7 in which Rz2 was 1.26 μm, the evaluation concerning a black streak was "C". In Example 8 in which Rz2 was 0.17 μm, the evaluation concerning a black streak was "A". From these results, it was found that making the ten point height of roughness profile Rz2 of the base portion small is effective for suppressing the external additive filming of the charging roller.

As described above, according to the present exemplary embodiment, it was found that it is important that values of the ten point height of roughness profile Rz1 of the entire surface and the ten point height of roughness profile Rz2 of the base portion of the surface of the charging roller satisfy certain ranges. That is, in the case where these parameters Rz1 and Rz2 satisfied $10 \leq Rz1 \leq 20$ and $Rz2 \leq 1$, the uniformity of the charging potential was secured, and the occurrence of toner filming and external additive filming was suppressed. As a result of this, it has become possible to provide a charging roller capable of maintaining good image quality for a long period of time. Such a charging roller can be preferably used with a developer including a toner having an average particle diameter of 10 μm or smaller and an external additive having a volume average particle diameter of 0.5 μm or smaller in an electrophotography apparatus.

As described above, according to the present invention, good image quality can be maintained for a long period of time.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-091552, filed on May 10, 2018, which is hereby incorporated by reference herein in its entirety.

What is claimed is:

1. A charging roller configured to charge a surface of an image bearing member configured to bear an image, the charging roller comprising:

a shaft portion;

an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$.

2. The charging roller according to claim 1, wherein the reduced peak height Spk, the reduced dale height Svk, and the core height Sk further satisfy $Spk+Sk<7.0$ and $Svk<0.9$.

3. The charging roller according to claim 1, wherein an average film thickness of the surface layer is 20 μm.

4. The charging roller according to claim 1, wherein at least a part of the particles project by 4 μm or more with respect to an area of a surface of the surface layer where the particles are absent.

5. The charging roller according to claim 1, wherein a ratio of a mass of the particles comprised in the surface layer to a mass of the surface layer excluding the particles is 50% or lower.

6. The charging roller according to claim 1, wherein the particles comprise first particles having an average particle diameter D1 (μm) and second particles having an average particle diameter D2 (μm) smaller than D1, and wherein the average particle diameters D1, D2 of the first particles and the second particles satisfy $5<D1<20$ and $3<D2 \leq (D1)/2$.

7. A cartridge comprising:

a rotatable image bearing member; and a charging roller configured to charge a surface of the image bearing member, wherein the charging roller comprises:

a shaft portion;

an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$.

8. The cartridge according to claim 7, further comprising a developing unit configured to develop an electrostatic latent image born on the image bearing member by using developer, wherein a volume average particle diameter of toner contained in the developer is 10 μm or smaller, and a volume average particle diameter of an external additive contained in the developer is 0.5 μm or smaller.

9. The cartridge according to claim 7, further comprising a voltage application unit configured to apply a direct current voltage to the charging roller to charge the surface of the image bearing member.

10. An image forming apparatus comprising:

a rotatable image bearing member;

a charging roller configured to charge a surface of the image bearing member; and a developing unit configured to develop, by using developer containing toner, an electrostatic latent image born on the image bearing member, wherein the charging roller comprises:

a shaft portion;

an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.5 \leq Svk \leq 1$, and wherein an average particle diameter of the toner contained in the developer is 10 μm or smaller, and an average particle diameter of an external additive contained in the developer is 0.5 μm or smaller.

11. The image forming apparatus according to claim 10, further comprising a voltage application unit configured to apply a direct current voltage to the charging roller to charge the surface of the image bearing member.

12. A charging roller configured to charge a surface of an image bearing member configured to bear an image, the charging roller comprising:

a shaft portion;

an elastic layer formed around the shaft portion; and a surface layer formed around the elastic layer, wherein particles having particle diameters within a range of 2 μm or larger and 15 μm or smaller and dispersed in the surface layer, and wherein a reduced peak height Spk (μm), a reduced dale height Svk (μm), and a core height Sk (μm) with respected to the surface layer of the charging roller satisfy $4 \leq Spk+Sk \leq 8$ and $0.4 \leq Svk \leq 1$.

* * * * *